United States Patent [19]

Matsui et al.

[11] Patent Number: 4,914,417

[45] Date of Patent: Apr. 3, 1990

[54] VARIABLE RESISTOR

[75] Inventors: Kenji Matsui; Fumitoshi Masuda; Yukinori Ueda, all of Kyoto, Japan

[73] Assignee: Murata Manufacturing Co., Ltd., Kyoto, Japan

[21] Appl. No.: 281,711

[22] Filed: Dec. 9, 1988

[30] Foreign Application Priority Data

Dec. 10, 1987 [JP] Japan ..... 62-313060

[51] Int. Cl.[4] ..... H01C 10/34

[52] U.S. Cl. ..... 338/174; 338/162; 338/175

[58] Field of Search ..... 338/174, 188, 162, 159, 338/175, 164

[56] References Cited

U.S. PATENT DOCUMENTS

| | | | |
|---|---|---|---|
| 3,631,371 | 12/1971 | Maurice | 338/164 |
| 4,114,131 | 9/1978 | Nakatsu et al. | 338/162 |
| 4,210,896 | 7/1980 | Van Benthuysen | 338/159 |
| 4,835,511 | 5/1989 | Henmi | 338/174 |

FOREIGN PATENT DOCUMENTS

| | | |
|---|---|---|
| 60-18506 | 2/1985 | Japan . |
| 60-20106 | 2/1985 | Japan . |
| 61-265801 | 11/1986 | Japan . |

*Primary Examiner*—B. A. Reynolds

*Assistant Examiner*—M. Lateef

*Attorney, Agent, or Firm*—Armstrong, Nikaido, Marmelstein, Kubovcik, Murray

[57] ABSTRACT

A variable resistor whose resistance is adjustable by rotating a rotor on an insulating substrate having an arcuate resistive element. The rotor is formed of an insulating resin and includes an inner skirt and an outer skirt extending from a bottom surface thereof. The inner skirt contacts the upper surface of the insulating substrate inside the arcuate resistive element. A metallic slider is integrated with the rotor by insert molding. The slider comprises a base formed of a metal plate folded at least into two, and arms having contacts at the tips thereof for slidably contacting the resistive element on the insulating substrate. The arms are folded along lines which are parallel to a line extending from the center of the base to the contacts of the arms to cause the contacts to project toward the insulating substrate. One of the metal plates forming the base cooperates with the inner and outer skirts of the rotor to seal a space accommodating the resistive element and the arms of the slider. External electrodes formed on the insulating substrate, with each of them connected with the resistive element, comprises a lower layer of silver, an intermediate layer of nickel or a nickel alloy, and an upper layer of tin or a tin-lead alloy.

10 Claims, 8 Drawing Sheets

VARIABLE RESISTOR

BACKGROUND OF THE INVENTION (1) Field of the Invention

The present invention relates to a variable resistor to mount on a surface such as a printed circuit board, whose resistance is adjustable by rotating a slider on a resistive element formed on an insulating substrate.

(2) Description of the Prior Art

A known example of such a variable resistor is illustrated in FIGS. 1 and 2A through 2C. FIG. 1 is an exploded perspective view, FIG. 2A a plan view, FIG. 2B a cross sectional view along the A—A line of FIG. 2A, FIG. 2C a bottom view, and FIG. 2D a vertical cross sectional view illustrating an external electrode in details.

In the illustrated variable resistor, an insulating substrate 1 has a bore 1*a* at the substantial center thereof. The insulating substrate 1 includes an arcuate resistive film 2 formed on the upper surface thereof concentrically with the bore 1*a*. An external electrode 3 is electrically connected to one end of the resistive film 2, and another external electrode 4 to the other end thereof. As illustrated in FIG. 2D, the external electrode 3 comprises silver-palladium alloys 3*a* and 3*b* respectively printed and fired on the upper and bottom surfaces of the insulating substrate 1 and another silver-palladium alloy 3*c* formed by such a method as dipping and fired on the end surface thereof. The resistive film 2 is printed on the insulating substrate 1 thereafter. An electrode 5 comprises a metal plate, on which a hollow central cylinder 6 is integrally formed by such a method as drawing. The electrode 5 is fixed to the bottom and end surfaces of the insulating substrate 1 with the hollow central cylinder 6 inserted into the bore 1*a*. A slider 7 comprises a bore 7*a* at the substantial center thereof, a contact 7*b* for contacting the resistive film 2, and a cutout 7*c*. The contact 7*b* and the cutout 7*c* are on the outer periphery of the slider 7. A metallic rotor 8 has a bore 8*a* at its substantial center, a cross-shaped driver groove 8*b* on its upper surface, and a projection 8*c* at a peripheral position on the bottom surface thereof. The hollow central cylinder 6 of the electrode 5 extends through the bores 7*a* and 8*a* of the slider 7 and rotor 8, with the projection 8*c* engaged with the cutout 7*c* of the slider 7. The assembly of the slider 7 and rotor 8 are rotatably mounted on the insulating substrate 1 by caulking the top of the hollow central cylinder 6 around the mouth of the bore 8*a*. The slider 7 and rotor 8 are rotatable in unison by the engagement between the cutout 7*c* and the projection 8*c*. With this variable resistor, resistance is adjusted as follows: The tip of a driver is fitted into the driver groove 8*b* and is rotated, which causes the slider 7 and the rotor 8 to rotate, whereby the contact 7*b* slides on the resistive film 2 to adjust the resistance between the external electrode 3 or 4 and the electrode 5.

Another known variable resistor is illustrated in FIGS. 3A and 3B. This variable resistor is contained in a case 13 in order to realize the mounting by flow soldering. As for the same parts with those in FIGS. 1 and 2A through 2C, identical numbers are used and the explanation is omitted.

This variable resistor comprises electrodes 9, 10 and 11 formed of metal plates. The electrodes 9 and 10 are attached to the same end surface of an insulating substrate 1 and electrically connected to the respective end of the resistive film 2. The electrodes 9 and 10 correspond to the electrodes 3 and 4 of the foregoing variable resistor, the electrode 11 to the electrode 5 thereof, and a central cylinder 12 to the hollow central cylinder 6 thereof. The slider 7 and the rotor 8 are rotatably mounted on the insulating substrate 1 by caulking the top of the central cylinder 12 around the mouth of the bore 8*a* of the rotor 8. The resin case 13 has an opening on the upper surface thereof. The insulating substrate 1 is insert-molded into the resin case 13, with the electrodes 9, 10 and 11 exposed outside and with the upper surface of the substrate 1 forming the floor of the inner space. The exposed electrodes 9, 10 and 11 are bent over to the bottom surface of the case 13. A heat-resistant film covering 14 is sticked around the opening of the case 13 to seal the opening. The film covering 14 is formed of a transparent material, through which the interior of the variable resistor is seen as shown in FIG. 3A.

After this variable resistor is mounted on a printed circuit board or the like by such a method as flow soldering, the film covering 14 is broken with a driver or the like, and then the slider 7 and the rotor 8 are rotated with the driver to cause the contact 7*b* to slide on the resistive film 2 for resistance adjustment.

The above two known variable resistors have the following disadvantages.

In the variable resistor shown in FIGS. 1 and 2, the resistive film 2 and the slider 7 are exposed outside. Therefore, flow soldering, which provides high productivity, cannot be used for mounting it on a printed circuit board, but reflow soldering have to be instead. Moreover, even in mounting by reflow soldering, flux tends to be scattered onto the resistive film 2 and the slider 7 to cause imperfect contact.

This variable resistor employs the silver-palladium alloy for the external electrodes 3 and 4 to prevent silver from leaching in solder and to improve the abrasion-resistance against solder of the external electrodes 3 and 4. However, the above alloy is expensive and is not perfect in preventing silver from leaching in solder. Also, because the alloy 3*c* on the end surface of the insulating substrate 1 is inevitably thick, glass frit is exposed on its surface and makes it hard to solder, which necessitates complicated preliminary soldering.

The variable resistor shown in FIG. 3, which is contained in the case 13, can be mounted on a printed circuit board by flow soldering, but includes many parts and so is troublesome and costly to manufacture. Moreover, when breaking the film covering 14 with a driver or the like, fragments of the film covering 14 tend to be scattered inside and outside the case 13, thereby causing imperfect contact inside the variable resistor or bringing a detrimental effect to the device on which the variable resistor is mounted. Further, once the film covering 14 is broken, the resistive film 2 and the slider 7 are exposed. This means the device cannot be re-adjusted or re-washed.

SUMMARY OF THE INVENTION

A primary object of the present invention, therefore, is to provide an improved variable resistor for surface mounting.

Another object of the invention is to provide a variable resistor which may be mounted on a surface by flow soldering.

A further object of the invention is to provide a variable resistor in which the resistive element and the slider are maintained in a sealed state after a resistance adjustment so as to allow re-adjustment and re-washing.

A still further object of the invention is to provide a variable resistor which is easy to solder and requires no preliminary soldering.

The above objects are fulfilled according to the present invention by a variable resistor whose resistance is adjustable through a rotating operation comprising an insulating substrate including an arcuate resistive element; external electrodes formed on the insulating substrate, each connected to an end of the resistive element, and each comprising a lower layer formed of a material appropriate to plate, an intermediate layer for plating the lower layer with another material which improves its abrasion-resistance against solder, and an upper layer for plating the intermediate layer with still another material which has excellent solderability, a rotor formed of an insulating material and rotatably mounted on the insulating substrate, wherein a bottom surface facing the insulating substrate has a sealing means for sealing a space accommodating the resistive element; and a metallic slider integrated with the rotor by insert molding, wherein the slider has a base embedded in the rotor and arms extending from the base, wherein the base comprises at least two layers of metal plate, one of which closes an upper opening of the space accommodating the resistive element, wherein the arms are projected toward the insulating substrate in the space, and wherein contacts at the tips of the arms are in contact with the resistive element.

The lower layer of each external electrode may comprise silver, the intermediate layer of either nickel or a nickel alloy, and the upper layer of either tin or a tin-lead alloy.

The sealing means may comprise an inner and an outer skirts formed on the bottom surface of the rotor, wherein the skirts are in contact with the insulating substrate and cooperating with the base of the slider to seal the space accommodating the resistive element formed on the insulating substrate.

The variable resistor may further comprise elastic elements formed on the upper surface of the insulating substrate which contacts the skirts.

The arms of the slider may be formed on the periphery of the base and bent along lines which are parallel to a line extending from a center of the base to contacts of the arms, whereby the contacts are projected toward the insulating substrate.

The arms may comprise a pair of arcuate members extending in mutually opposite directions from peripheral positions of the base, with the contacts thereof arranged out of touch with each other on a radius of the base to be free from mutual interference.

The variable resistor may further comprise an electrode formed on the bottom and end surfaces of the insulating substrate, wherein the electrode has a central cylinder projected from a surface thereof and inserted centrally through the insulating substrate, the slider and the rotor with a top thereof caulked, whereby the rotor is rotatable on the insulating substrate.

According to the present invention, since the slider having a base consisting of at least two layers is insert-molded into the rotor, tight sealing is assured at the junction between the rotor and the slider. Such a sealing structure enables the variable resistor to be mounted on the surface of a device by flow soldering and to be manufactured more easily and at a lower cost than the existing variable resistors. The variable resistor according to the present invention neither requires the trouble of breaking the film covering after mounting nor has the problem of imperfect contact caused by the scattered fragments of the broken covering. This constantly sealed structure realizes excellent environment-resistance and allows the variable resistor mounted on the device to be re-adjusted and re-washed. Furthermore, the slider has the arms bent along lines which are parallel to a line extending from the center of the base to the contacts of the arms, which enables the slider to be insert-molded into the rotor with the contacts and arms accommodated in a space defined by a metal mold.

Each external electrode comprises a lower layer formed of a material appropriate to plate, an intermediate layer for plating the lower layer with another material which improves its abrasion-resistance against solder, and an upper layer for plating the intermediate layer with still another material which has excellent solderability. Therefore, the intermediate layer acts as a barrier for the lower layer. That is, even if silver is employed for the lower layer, the intermediate layer securely prevents silver from leaching in solder so as to improve the abrasion-resistance against solder of the lower layer. This means the expensive silver-palladium alloy is not required for the external electrode. Because the upper layer realizes easy soldering, complicated preliminary soldering is not necessary, and even eutectic solder may be used. Consequently, external electrodes may be manufactured at a low cost.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENT

Figure 1:
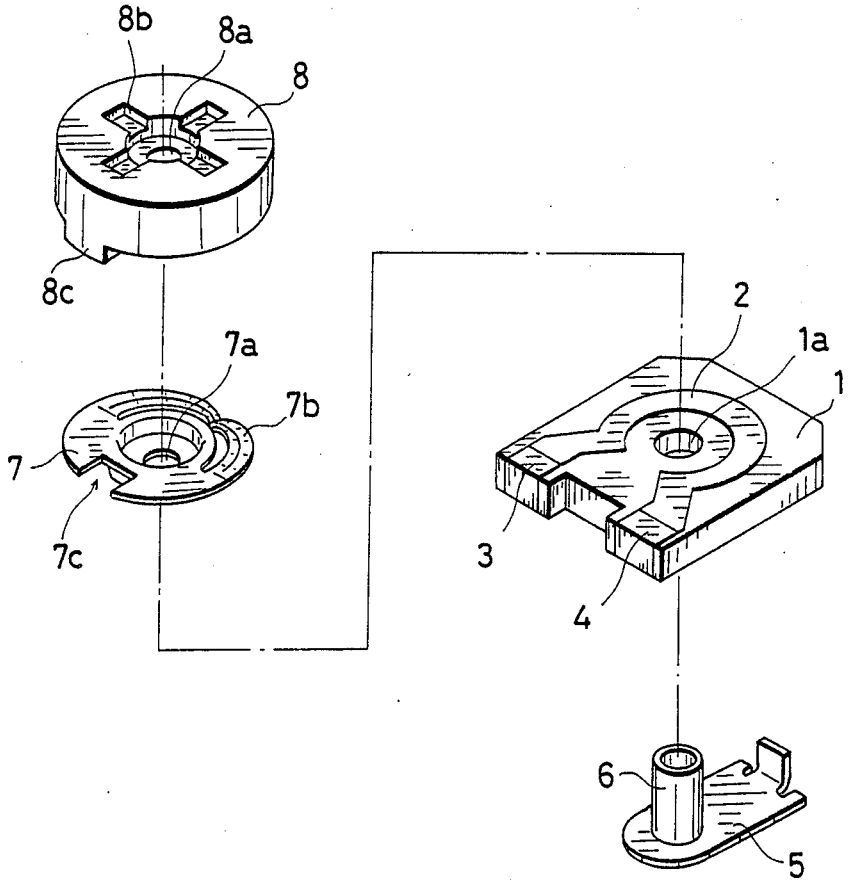
Fig. 1 Prior Art
FIG. 1 is an exploded perspective view of a known variable resistor.
Figure 2A:
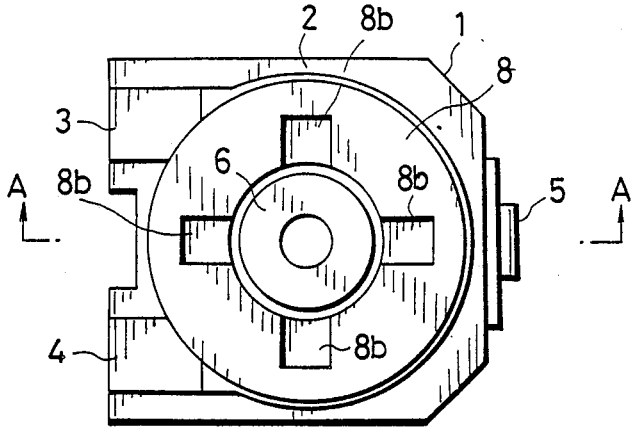
Fig. 2A Prior Art
FIG. 2A is a plan view of the same.
Figure 2B:
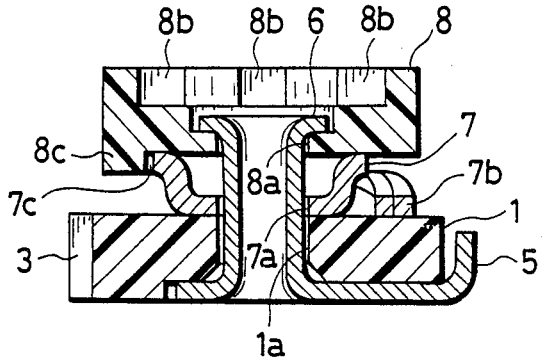
Fig. 2B Prior Art
FIG. 2B is a cross sectional view along the A—A line of FIG. 2A.
Figure 2C:
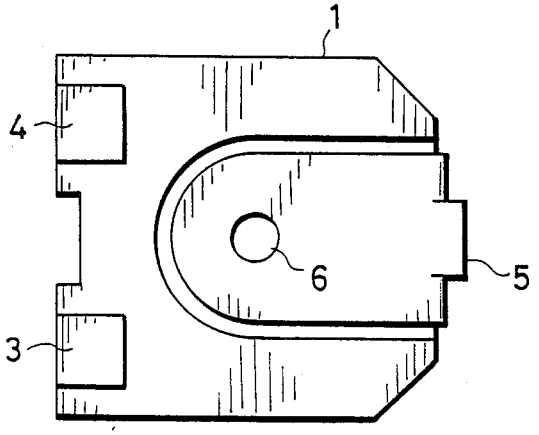
Fig. 2C Prior Art
FIG. 2C is a bottom view of the above variable resistor.
Figure 2D:
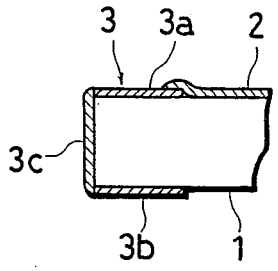
Fig. 2D PRIOR ART
FIG. 2D is a vertical cross sectional view illustrating an external electrode of the above variable resistor in details.
Figure 4:
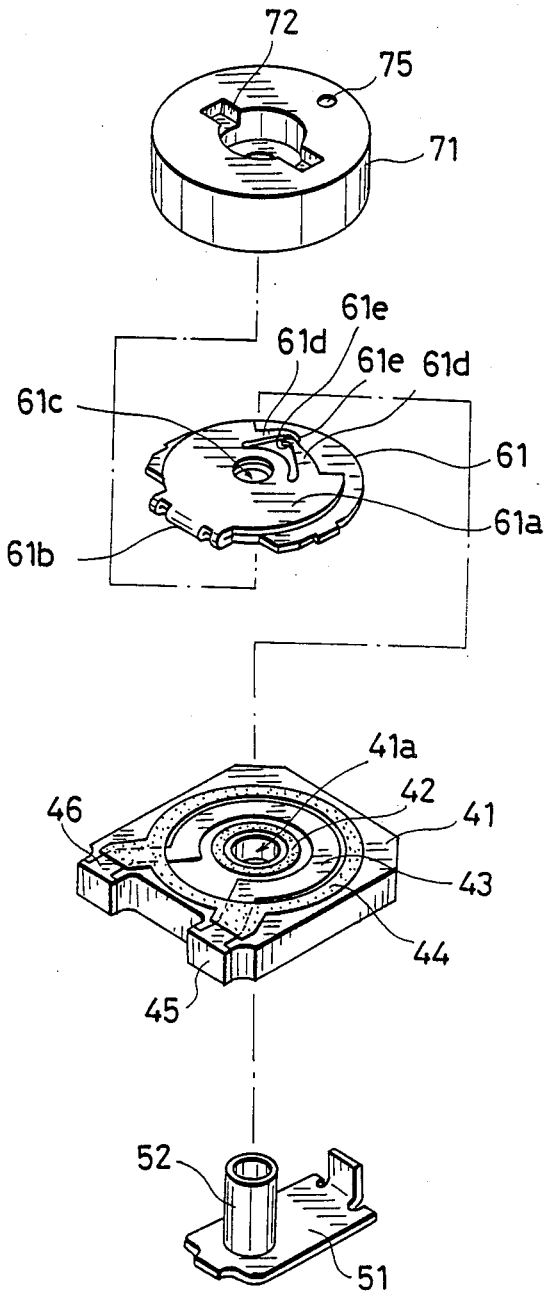
FIG. 4 is an exploded perspective view of an embodiment according to the present invention.

FIG. 4 is an exploded perspective view of a variable resistor embodying the present invention. An insulating substrate 41 has a bore 41*a* at the substantial center thereof. An inner elastic element 42, a resistive film 43 and an outer elastic element 44, all having different diameters, are formed on the upper surface of the insulating substrate 1 concentrically with the bore 41*a*. The inner and outer elastic elements 42 and 44 may be formed of such an insulating material as silicone elastomer, which is resistant to the flow soldering temperature and to the flux cleaning solvent. The elastic elements 42 and 44 may be sticked to the insulating substrate 41 by such a method as screen process printing, drawing, or dipping. The resistive film 43 may be formed of cermet, carbon or the like, and may be formed on the insulating substrate 41 by screen process printing or the like in the illustrated pattern, dried and burned.

The resistive film 43 is connected to an external electrode 45 at one end thereof and to another external electrode 46 at the other end thereof. The external electrodes 45 and 46 will be described later.

Figure 6A:
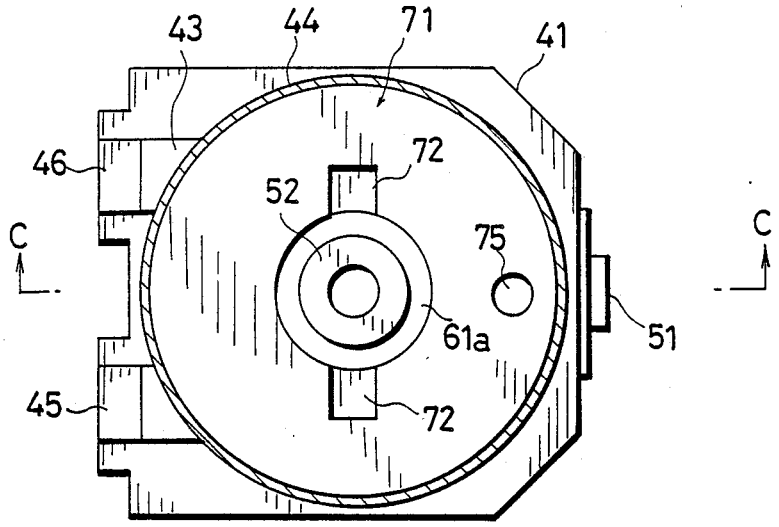
FIG. 6A is a plan view of the variable resistor in FIG. 4.
Figure 6B:
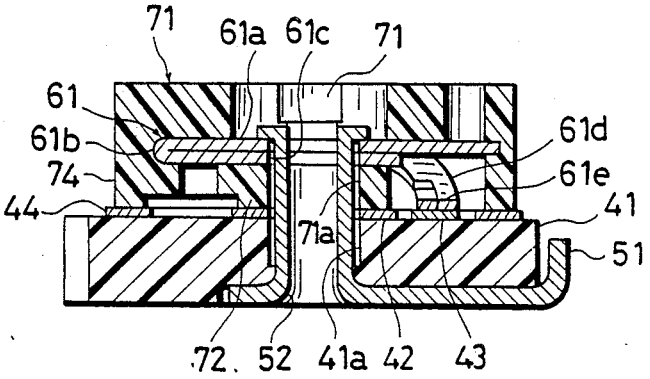
FIG. 6B is a cross sectional view along the C—C line of FIG. 6A.

An electrode 51 comprises a metal plate, on which a hollow central cylinder 52 is integrally formed by such a method as drawing. As shown in FIG. 6B, the electrode 51 is fixed on the bottom and end surfaces of the insulating substrate 41 with the hollow central cylinder 52 inserted into the bore 41*a* thereof.

Figure 5A:
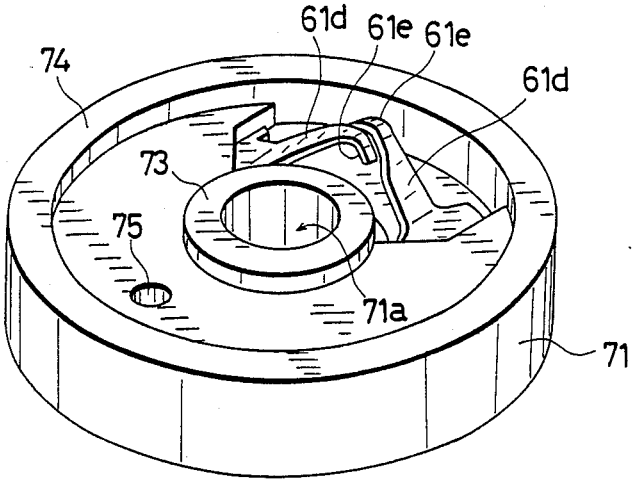
FIG. 5A is a perspective view of a rotor of the above embodiment as seen from below.
Figure 5B:
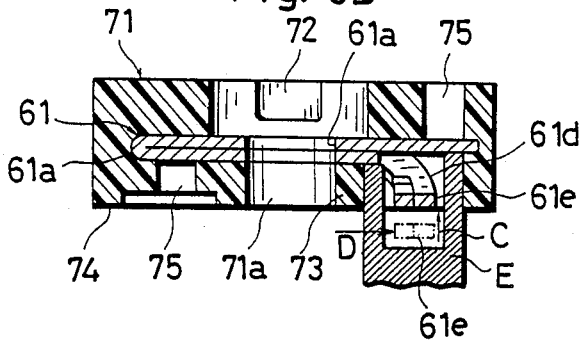
FIG. 5B is a cross sectional view of the above rotor.
Figure 5C:
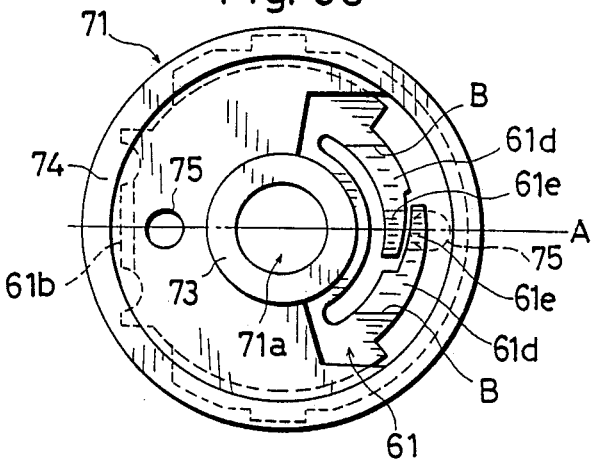
FIG. 5C is a bottom view of the above rotor.

A slider 61 is obtained by press-working a conductive metal plate into the shape shown in FIG. 4. The slider 61 comprises a base 61*a* and a pair of arms 61*d* disposed on the outer periphery thereof. The base 61*a* is folded into two at an end 61*b* and has a bore 61*c* at the center thereof. The arms 61*d* extend in circumferential directions and have contacts 61*e* at the respective tip thereof. As shown in FIG. 5C, the arms 61*d* are bent along lines B, which are parallel to a line A extending from the center of base 61*a* to the contacts 61*e*. Also, as shown in FIG. 5C, the contacts 61*e* are out of contact to avoid mutual interference, whereby each contact 61*e* is operable freely to have excellent contact with the resistive film 43. It is to be noted that, for the purpose of an easy illustration, FIG. 4 shows the slider 61 upside down. Although the slider 61 is illustrated separately from the rotor 71, the slider 61 is insert-molded into the rotor 71 to form an integral unit in practice.

The rotor 71 is formed of a thermosetting resin having excellent heat resistance or a thermoplastic resin which also has excellent heat resistance such as PPS, and has the slider 61 insert-molded into it. The rotor 71 has a bore 71 at the substantial center thereof and a cross-shaped driver groove 72 on the upper surface thereof. As shown in FIGS. 5A through 5C, the bottom surface of the rotor 71 includes an inner annular skirt 73 and an outer annular skirt 74. When the rotor 71 is mounted on the insulating substrate 41, the inner skirt 73 is in elastic contact with the inner elastic element 42 and the outer skirt 74 with the outer elastic element 44 on the insulating substrate 41.

The external electrode 45 will be explained in details hereinafter. The external electrode 46 has the same construction though not shown here.

Figure 7:
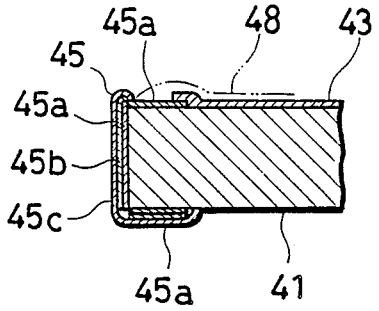
FIG. 7 is a vertical cross sectional view illustrating an external electrode of the above embodiment in details.
Figure 3A:
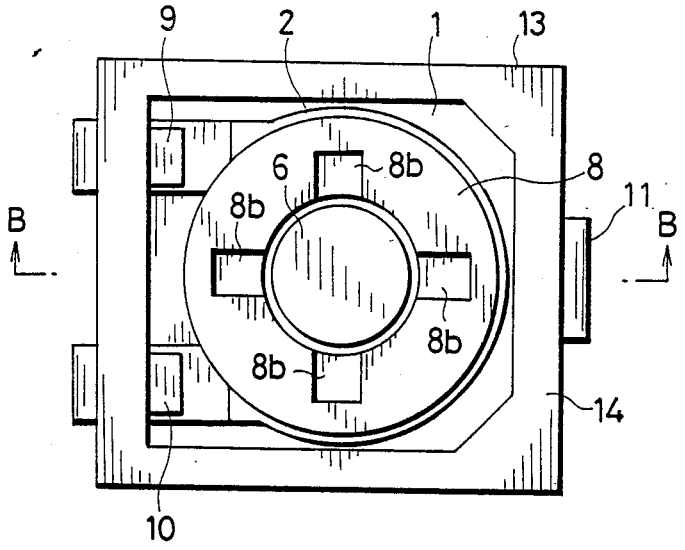
Fig. 3A Prior Art
FIG. 3A is a plan view of another known variable resistor.
Figure 3B:
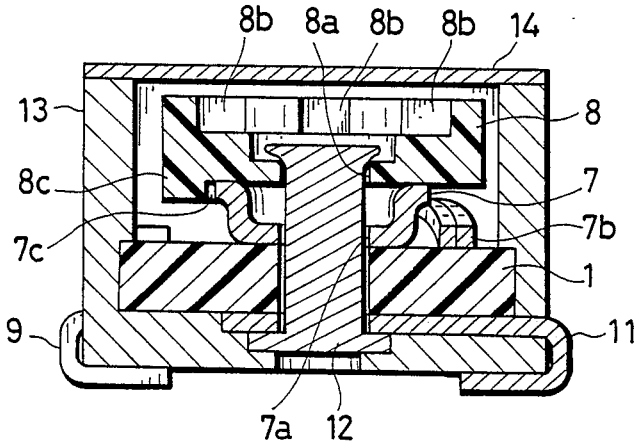
Fig. 3B Prior Art
FIG. 3B is a cross sectional view along the B—B line of FIG. 3A.

As illustrated in FIG. 7, the external electrode 45 comprises a lower layer 45*a*, a first plated layer (intermediate) 45*b*, and a second plated layer (upper) 45*c*. The lower layer 45*a* comprises silver silver-palladium alloy printed and fired on the upper surface and silver printed and fired on the bottom and the end surfaces of the insulating substrate 41. The thickness is, for example, 2 Mm. The first plated layer 45*b* comprises nickel or a nickel alloy and has a thickness of, for example, 2 Mm. The second plated layer 45*c* comprises tin or a tin-lead alloy and has a thickness of, for example, 4 Mm.

The first plated layer 45*b* acts as a barrier for preventing the silver of the lower layer 45*a* from leaching in solder, and as a result improves the abrasion-resistance against solder of the lower layer 45*a*. The second plated layer 45*c* makes the electrode 45 easier to apply solder, and also dispenses with preliminary soldering.

The external electrode 45 is manufactured as follows: First, the lower layer 45*a* is formed on the upper, bottom and end surfaces of the insulating substrate 41, and the resistive film 43 is formed as shown in FIG. 7. Then, a plating resist 48 is applied on the resistive film 43 in the manner shown with a two-dot chain line in FIG. 7. After the first and the second plated layers 45*b* and 45*c* are formed, the plating resist 48 is removed.

How to assemble the foregoing parts to form the variable resistor will be described below. First, the rotor 71 is formed with the slider 61 insert-molded therein. The contacts 61*e* of the slider 61 are at positions shown with a chain line in FIG. 5B when they are not being pressurized. When the slider 61 and the rotor 71 are mounted on the insulating substrate 41, the contacts 61*e* are elevated in the direction of an arrow C to positions shown with a solid line. The contacts 61*e* are vertically movable in the direction of the arrow C because the arms 61*d* are bent along the lines B, which are parallel to the line A. If the arms 61*d* were bent along the lines which are not parallel to the line A, the contacts 61*e*, when not pressurized, would have to be out of the chain line positions in the direction of an arrow D or in the opposite direction in order to be at the solid line positions when the slider 61 and rotor 71 are mounted on the substrate 41. The rotor 71 is molded with the contacts 61*e* and the arms 61*d* contained in a space defined by a metal mold E shown in FIG. 5B. Therefore, if the contacts 61*e* were out of the chain line positions in the direction of the arrow D or in the opposite direction, the contacts 61*e* and the arms 61*d* could not be contained in the space defined by the metal mold E. In other words, the molding of the rotor 71 is possible where, as in this embodiment, the arms 61*d* are bent along the lines B which are parallel to the line A so that the contacts 61*e* are vertically movable in the direction of the arrow C.

The rotor 71 has bores 75 which are left after pins are pulled out for supporting the slider 61 during the molding operation.

The rotor 71 thus formed with the slider 61 insert-molded therein is rotatably mounted on the insulating substrate 41 with the hollow central cylinder 52 inserted through the bores 71*a* and 61*c* and with the top of the hollow central cylinder 52 caulked around the mouth of the bore 61*c* as illustrated in FIG. 6B.

Figure 6C:
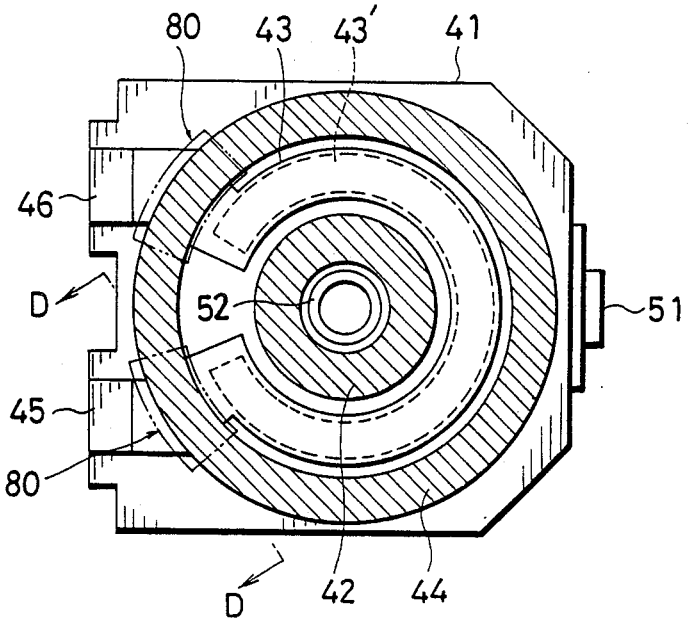
FIG. 6C is a plan view of an insulating substrate of the above embodiment.
Figure 6D:
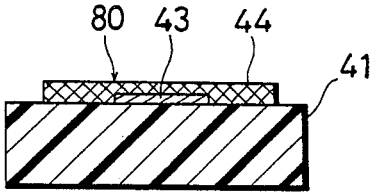
FIG. 6D is a cross sectional view along the D—D line of FIG. 6C.

In FIG. 6C, a dashed line indicates a portion 43' of the resistive film 43 over which the slider 61 is slidable, and two-dot chain lines indicate positions 80 where the resistive film 43 and the outer skirt 74 of the rotor 71 are overlapped.

In the variable resistor having the foregoing construction, the space defined by the insulating substrate 41 and the rotor 71, where the contacts 61*e* are situated, is sealed tight. That is, the junction between the rotor and the slider, which is not sealed tight in the prior art, is now provided with reliable sealing by this construction, in which the slider 61 has the base 61*a* folded into two and is insert-molded into the rotor 71. The tight sealing is further assured by the inner and outer elastic elements 42 and 44 interposed between the inner and outer skirts 73 and 74 formed on the rotor 71 and the upper surface of the insulating substrate 41. Consequently, the resistive film 43 and the slider 61 are sealed tight, which allows the variable resistor to be mounted by flow soldering and to be cleaned with flux.

The foregoing embodiment is one example of a variable resistor according to the present invention, and may of course be modified within the scope and spirit of the invention. In particular, the sealing structure between the upper surface of insulating substrate 41 and the rotor 71 may take various forms. For example, the inner and outer elastic elements 42 and 44 may be replaced with other types of elastic material such as O-rings. Further, the slider 61 may comprise two members assembled by welding or the like instead of one member folded into two. For the first and second plated layers 45*b* and 45*c* of the external electrode 45, various other materials may be used. Any material which improves the abrasion-resistance against solder of the lower layer 45*a* may be used for 45*b*, and any other material which has excellent solderability for 45*c*.

What is claimed is:

1. A variable resistor whose resistance is adjustable through a rotating operation, comprising;

an insulating substrate including an arcuate resistive element, external electrodes formed on said insulating substrate, each connected to an end of said resistive element and each comprising a lower layer formed of a material appropriate to plate, an intermediate layer for plating the lower layer with another material which improves its abrasion-resistance against solder and an upper layer for plating the intermediate layer with still another material which has excellent solderability;

a rotor formed of an insulating material and rotatably mounted on said insulating substrate, wherein a bottom surface facing said insulating substrate has a sealing means for sealing a space accommodating said resistive element, and a metallic slider integrated with said rotor by insert molding, wherein said slider has a base embedded in said rotor and arms extending from the base, wherein the base comprises at least two layers of metal plate, one of which closes an upper opening of said space accommodating said resistive element, wherein the arms are projected toward said insulating substrate in said space, and wherein contacts at the tips of the arms are in contact with said resistive element.

2. A variable resistor as claimed in claim 1, wherein each of said external electrodes comprises the lower layer formed of silver, the intermediate layer of nickel and the upper layer of tin.

3. A variable resistor as claimed in claim 1, wherein each of said external electrodes comprises the lower layer formed of silver, the intermediate layer of a nickel alloy and an upper layer of tin.

4. A variable resistor as claimed in claim 1, wherein each of said external electrodes comprises the lower layer formed of silver, the intermediate layer of nickel and an upper layer of a tin-lead alloy.

5. A variable resistor as claimed in claim 1, wherein each of said external electrodes comprises the lower layer formed of silver, the intermediate layer of a nickel alloy and an upper layer of a tin-lead alloy.

6. A variable resistor as claimed in claim 1, wherein said sealing means comprises an inner and an outer skirts formed on the bottom surface of said rotor, wherein the skirts are in contact with said insulating substrate and cooperating with the base of said slider to seal said space accommodating said resistive element formed on said insulating substrate.

7. A variable resistor as claimed in claim 6, further comprising elastic elements formed on the upper surface of said insulating substrate which contacts the skirts.

8. A variable resistor as claimed in claim 1, wherein the arms of said slider are formed on the periphery of the base and bent along lines which are parallel to a line extending from a center of the base to the contacts of the arms, whereby the contacts are projected toward said insulating substrate.

9. A variable resistor as claimed in claim 8, wherein the arms comprise a pair of arcuate members extending in mutually opposite directions from peripheral positions of the base, with the contacts thereof arranged out of touch with each other on a radius of the base to be free from mutual interference.

10. A variable resistor as claimed in claim 1, further comprising;

an electrode formed on the bottom and end surfaces of said insulating substrate, wherein said electrode has a central cylinder projected from a surface thereof and inserted centrally through said insulating substrate, said slider and said rotor with a top thereof caulked, whereby said rotor is rotatable on said insulating substrate.

* * * * *